US006227171B1

(12) United States Patent
Matsuda

(10) Patent No.: US 6,227,171 B1
(45) Date of Patent: May 8, 2001

(54) FUEL REGULATION APPARATUS AND FUEL INJECTION APPARATUS OF ENGINE FOR MODEL

(75) Inventor: Norio Matsuda, Mobara (JP)

(73) Assignee: Futaba Denshi Kogyo K.K., Mobara (JP)

( * ) Notice: Subject to any disclaimer, the term of this patent is extended or adjusted under 35 U.S.C. 154(b) by 0 days.

(21) Appl. No.: 09/293,879

(22) Filed: Apr. 19, 1999

(30) Foreign Application Priority Data

May 15, 1998 (JP) ..... 10-133504

(51) Int. Cl.[7] ..... F02M 37/04
(52) U.S. Cl. ..... 123/458; 123/DIG. 3
(58) Field of Search ..... 123/DIG. 3, DIG. 5, 123/462, 458, 460, 457, 510

(56) References Cited

U.S. PATENT DOCUMENTS 2,800,121 * 7/1957 Fletcher ..... 123/462
3,734,072 * 5/1973 Yamda ..... 123/DIG. 5
3,800,754 * 4/1974 Carlson ..... 123/DIG. 5
4,957,072 * 9/1990 Goldowsky ..... 123/DIG. 3
4,984,547 * 1/1991 Muraji ..... 123/462
5,092,299 * 3/1992 Muntean ..... 123/462
5,479,899 * 1/1996 Phelps ..... 123/462
5,975,055 * 11/1999 Matsuda ..... 123/DIG. 3

* cited by examiner

*Primary Examiner*—Carl S. Miller
(74) *Attorney, Agent, or Firm*—Oblon, Spivak, McClelland, Maier & Neustadt, P.C.

(57) ABSTRACT

A fuel regulation apparatus of an engine for a model which is possible to regulate the flow rate of the fuel according to the rotational frequency of the engine is provided. A main body 31 of a fuel regulation apparatus 30 is provided with a fuel inlet 32, a fuel outlet 33, and an air inlet 42 to which air pressure from a crankcase is applied. The inlet 32 and the outlet 33 are connected therewith through a passage 34 having a seat face 37. A regulating valve 35 is placed in the passage 34 to close the seat face 37. A spring 38 pushes the regulating valve 35 in such a direction as to close the seat face. The other end of the regulating valve 35 is in contact with a piston 39. A position of an air inlet 42 can be adjusted by a screw 43. The spring pushes the piston 39 in such a direction as to open the seat face 37. The outlet 33 is connected to a fuel injection apparatus. The fuel injection apparatus injects the fuel into a crankcase. The piston is pushed according to air pressure in the crankcase 8 corresponding to rotational frequency and the seat face is opened. The flow rate can be controlled according to the rotational frequency of the engine. The fuel which is apt to be insufficient at the time of high speed can be increased and the fuel which is apt to be dense at the time of low speed can be throttled.

11 Claims, 3 Drawing Sheets

FUEL REGULATION APPARATUS AND FUEL INJECTION APPARATUS OF ENGINE FOR MODEL

BACKGROUND OF THE INVENTION

This invention relates to a fuel regulation apparatus for an engine for a model for regulating supply of fuel according to rotational frequency which is mounted to the engine for the model which pressurizes the fuel by varying air pressure generated in a crankcase when driving.

A carburetor has been conventionally used in a two-stroke cycle or four-stroke cycle glow engine as a means for regulating quantity of fuel supplied to a combustion chamber of the engine.

The present applicant has proposed an engine for a model equipped with a fuel injection apparatus instead of the carburettor. In this engine, air pressure generated in a crankcase is introduced into a combustion tank through a check valve and stored in the tank and fuel is pressurized to 20–100kPa.

The pressure generated in the crankcase of the engine varies depending on rotational frequency, that is to say, it is high at the time of high speed rotation, and it is low at the time of low speed rotation. Therefore, the fuel tank is constructed so that the maximum pressure can be stored therein. It is, however, difficult in practice to maintain stably a constant pressure, for example, at 30–40 kPa.

Therefore, a regulator has been conventionally used in order to control constantly the pressure of fuel supplied from the fuel tank to feed to a fuel injection apparatus. The regulator is an apparatus for passing only the fuel having a certain given pressure.

In a conventional engine of a model which pressurizes the fuel by air pressure in a crankcase and injects the fuel by a fuel injection apparatus, it is premised that the pressure of the fuel is constant, and the supply of the fuel is controlled by injection time. That is to say, when the rotational frequency is low, the injection time is shortened to decrease the quantity of the fuel, and when the rotational frequency is high, the injection time is lengthened to increase the quantity of the fuel.

At the time of low speed, however, the pressure of the fuel rises since the quantity of the fuel used is small, and the fuel becomes dense. And, since the quantity of the fuel used per unit time is large at the time of high speed, the supply of the fuel is not sufficient, and the fuel becomes thin. Therefore, in the conventional engine for a model, the rotation of the engine is unstable and it is possible in some instances that overheat takes place at the time of high speed and engine stop takes place at the time of low speed.

SUMMARY OF THE INVENTION

An object of this invention is to provide a fuel regulation apparatus for an engine of a model which is possible to regulate supply of pressurized fuel according to the high or low of the rotational frequency of the engine and a fuel injection apparatus using the same.

The fuel regulation apparatus (30) for an engine of a model described in claim 1 is mounted to the engine for the model (1) in which fuel is pressurized by air pressure generated in a crankcase (8) when driving and the fuel regulation apparatus for regulating supply of the fuel comprises a main body (31) provided with an inlet (32) and an outlet (33) for the fuel, a regulating valve (35) for regulating opening of a passage (34) between the inlet and outlet in the main body to regulate supply of the fuel, and a regulated air supplying part (42) for supplying the air pressure to the regulating valve in the main body in such a direction as to enlarge the opening of the passage.

The fuel regulation apparatus (30) for an engine of a model described in claim 1 is mounted to the engine for the model (1) in which fuel is pressurized by air pressure generated in a crankcase (8) when driving and the fuel regulation apparatus for regulating supply of the fuel comprises a main body (31), an inlet (32) for the fuel placed to the main body, an outlet (33) for the fuel placed to the main body, a passage (34) placed to the main body so as to connect the inlet with the outlet, a seat face (37) placed to the passage, a regulating valve (35) placed in the main body and reciprocating in the passage for regulating opening of the seat face, and a regulated air supplying part (42) for introducing the air pressure into the main body so as to push the regulating valve in such a direction as to open the seat face.

The fuel regulation apparatus for an engine of a model described in claim 3 is characterized in that the fuel regulation apparatus (30) for the engine of the model described in claim 2 is further provided with a first pushing means (38) for pushing the regulating valve (35) in such a direction as to close the seat face (37), an adjusting mechanism (43) for adjusting a position of the regulated air supplying part (42) relative to the main body in a direction of reciprocating motion of the regulating valve (35), and a second pushing means (44) placed between the regulated air supplying part (42) and the regulating valve (35) in the main body for pushing the regulating valve in such a direction as to open the seat face (44).

The fuel injection apparatus for an engine for a model described in claim 4 is characterized in that a fuel inlet for a fuel injection apparatus (50) is connected to the fuel outlet (33) of the fuel injection apparatus (30) of the engine for the model described in claim 3.

BRIEF DESCRIPTION OF THE DRAWINGS

For a more complete understanding of this invention may be had to the following detailed explanations in connection with the accompanying drawings, in which.

DESCRIPTION OF THE PREFERRED EMBODIMENTS

The first example of working embodiments of this invention is described with reference to FIGS. 1 and 2. This example is relating to a two-stroke cycle engine for a model provided with an electronic control fuel injection apparatus. The engine 1 for the model is constructed so as to pressurize fuel by the use of air pressure generated in a crankcase when driving. And, the supply of the pressurized fuel can be regulated by the use of the air pressure according to high and low of the rotational frequency of the engine and can be fed to the electronic control fuel injection apparatus.

Figure 1:
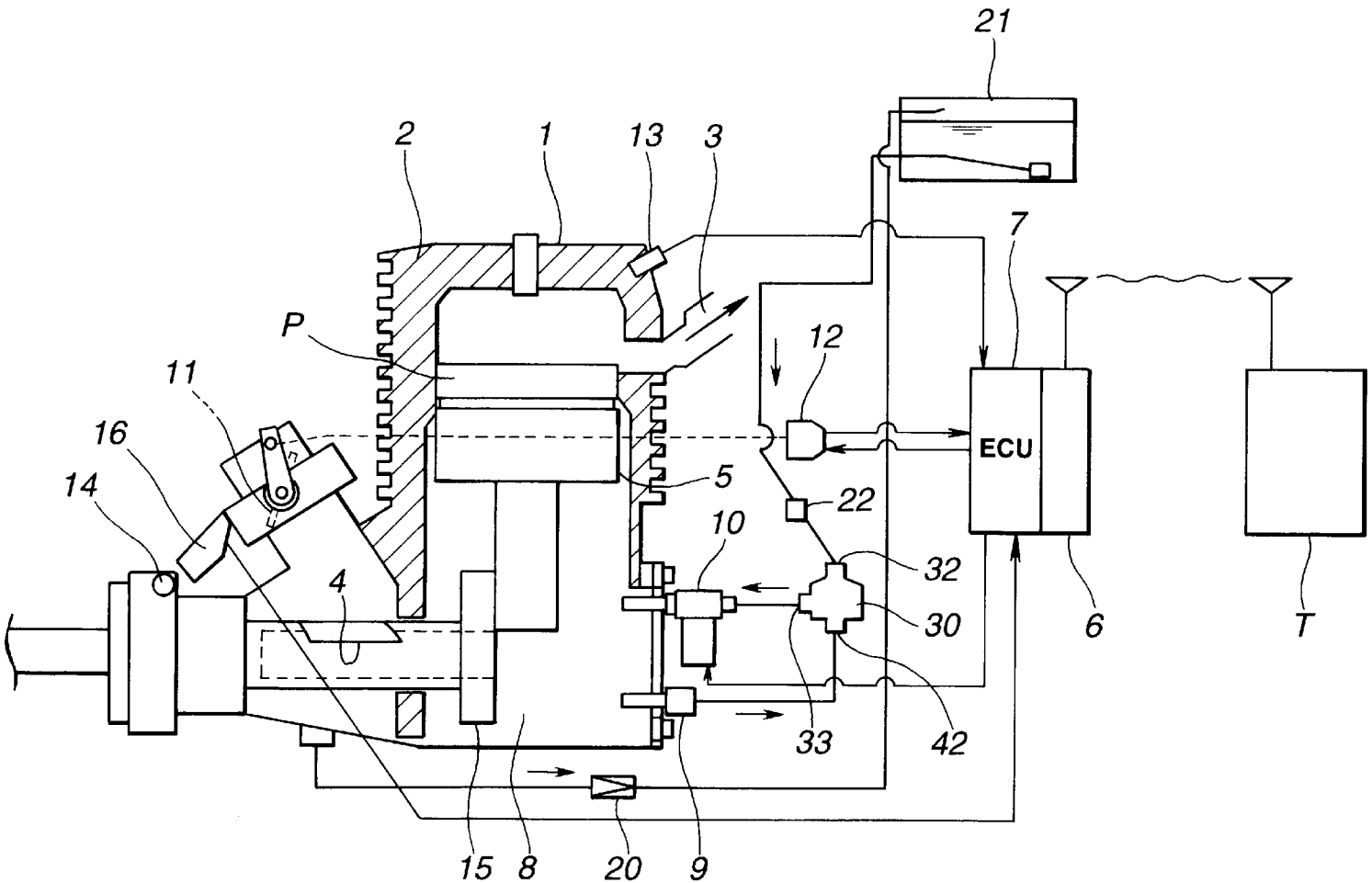
FIG. 1 is a block diagram showing a whole structure of an engine of a model of a first example of working embodiments of this invention.

As shown in FIG. 1, the two-stroke cycle engine is not provided with an inlet valve or an exhaust valve like a four-stroke cycle engine, and an exhaust port 3, an inlet port 4 and a scavenging port 5 are formed directly to a cylinder 2, which are opened by a piston P itself.

The engine 1 shown in FIG. 1 is started by a starter not shown in FIG. 1. The starter is driven by en electric power of a battery given through a rectifier or driven by supply of pressurized air supplied from a pressurizing means and the like.

The engine 1 is controlled by an electronic control unit 7 of a receiver 6 mounted to a radio controlled model airplane. If an operator operates a transmitter T and the receiver 6 receives wave from the transmitter T to control each part including an engine.

A permanent magnet 14 is placed to a position required of a driving shaft and a rotational position sensor 16 as a stroke detecting means for detecting a position of a crank 15 which detects the permanent magnet 14 to rotate is mounted to a prescribed position opposite to the permanent magnet 14. The rotational position sensor 16 detects the driving cycle of the engine 1 in order to determine the timing of injection of fuel. The output signal of the rotational position sensor 16 is transmitted to the electronic control unit 7 of the radio control receiver 6 and used to control the engine 1.

As shown in FIG. 1, it is not objectionable that a pressure sensor 9 is placed in the crankcase 8 to detect the driving cycle of the engine 1 from the variation in the pressure in the crankcase 8, thereby the timing of injection of fuel of the electronic control fuel injection apparatus 10 is determined. In such the case, the signal from the pressure sensor 9 is transmitted to the electronic control unit 7 on the basis of which signal the electronic control unit 7 controls the electronic control fuel injection apparatus 10.

The air inlet port 4 of the engine 1 is equipped with a throttle valve 11 for adjusting the quantity of air to be introduced. The opening of the throttle valve 11 is controlled by means of a driving means 12 such as a throttle servo and the like. The driving means 12 is controlled by means of the electronic control unit 7 of the radio control receiver 6. The cylinder 2 is equipped with a temperature sensor 13 the signal of which is inputted to the electronic control unit 7 of the radio control receiver 6 to be used to control the engine 1.

As shown in FIG. 1, in this example, the air pressure generated in the crankcase 8 is introduced through the check valve 20 into the fuel tank 21 to apply predetermined pressure to the fuel in the fuel tank 21. This pressure is, in general, a maximum pressure of pulsation generated in the crankcase 8. The fuel tank 21 is closed structure. The pressurized fuel is introduced through a filter 22 to the fuel regulation apparatus 30 described later and then supplied to the electronic control fuel injection apparatus 10 placed in the crankcase 8.

The fuel regulation apparatus 30 is explained with reference to FIG. 2. A fuel inlet 32 is formed to one edge face of a cylinder-shaped main body 31. The fuel inlet 32 is connected with the fuel tank 21 through the filter 22. A fuel outlet 33 is formed to a side face of the main body 31. The fuel inlet 32 and outlet 33 are connected each other through the passage 34 the cross section of which is nearly circle placed in the main body 31. A round bar-shaped regulating valve 35 (valving element) the diameter of which is somewhat smaller than that of the passage 34 is placed axially movably in the passage 34. An O-ring 36 as a sealing member is placed to one end of the regulating valve 35. A tapered seat face 37 is formed as a sealing position to the passage 34. When the regulating valve 35 moves and the O-ring 36 comes into contact with the seat face 37 with the prescribed force, the passage 34 is closed, and when the O-ring 36 is out of contact with the seat face 37, the passage 34 is opened. The first spring 38 is placed 2 between the inlet 32 and one end of the regulating valve 35. The first spring 38 is the first pushing means for pushing the regulating valve 35 in such a direction as to close the seat face.

The other end of the regulating valve 35 is in contact with a piston 39. The piston 39 is placed movably in a piston chamber 40 which is formed and opened at the other end of the main body 31. A packing 41 is placed between the piston 39 and the main body 31. An air inlet 42 as a regulated air supplying part is formed at the other end of main body 31.

Any material for decreasing the friction coefficient may be placed at the outer peripheral face of the piston 39 or inner peripheral face of the piston chamber 40 being in contact with the piston 39. If the outer peripheral face of the piston 39 or inner peripheral face of the piston chamber 40 being in contact with the piston 39 is coated with, for example, polytetrafluoroethylene (trade name "TEFLON") and the like to decrease the friction coefficient of both materials, the piston 39 is easily slidable to the variation in pressure and, consequently, the accuracy of regulation and the response can be increased and the fuel pressure can be more highly controlled.

The air inlet 42 is twisted in the opening of the piston chamber 40 by means of a screw 43, and the mounting position in axial direction relative to the main body 31 can be adjusted when rotating. That is to say, the screw member is a controlling mechanism for adjusting the position of the air inlet 42 to the main body 31 relative to a direction of reciprocating motion of the regulating valve 35. And, a second spring 44 is placed between the air inlet 42 and the piston 39 in the piston chamber 40. The spring 44 is the second pushing means for pushing the piston 39 in such a direction as to open the seat face 37 in the main body 31.

By virtue of the aforementioned controlling mechanism and the second spring 44, the position relative to the main body 31 can be adjusted by rotating the screw of the air inlet 42 and the second spring 44 can control through the piston 39 the force for pushing the regulating valve 35 in such a direction as to open. Thereby, a state of contact between the regulating valve 35 and the seat face 37 can be optionally regulated.

As shown in FIG. 1, the fuel outlet 33 of the fuel regulation apparatus 30 is connected to the electronic control fuel injection apparatus 10. The electronic control fuel injection apparatus 10 is equipped with a solenoid coil in a box. A valving element inserted movably in the solenoid coil is pushed in a prescribed direction by a pushing means to close an injection hole. When a voltage is applied to the solenoid coil, the valving element moves in the opposite direction to the aforementioned pushed direction to open the injection hole. The fuel the pressure of which is maintained at the prescribed pressure is introduced through the fuel regulation apparatus 30 into the box. The fuel is injected outward from the injection hole only while the voltage is applied to the solenoid coil and the injection hole is opened.

Next, an action of this example is explained.

The operation of this engine is explained. When the piston 39 descends by explosion of combustion gas, the exhaust port 3 opens first and emission of the combustion gas starts, and then the scavenging port 5 opens. The pressure in the cylinder 2 lowers and the pressure in the crankcase 8 rises. Air in the crankcase 8 flows into the cylinder 2 through the opened scavenging port 5 and the combustion gas in the cylinder 2 is extruded from the exhaust port 3. When the piston P starts to rise, the inside of the crankcase 8 is negative pressure and air starts to flow into the crankcase 8 from the inlet port 4.

The fuel which is pressurized in the fuel tank 21 passes through the filter 22 and the regulation of flow rate is carried out according to the rotational frequency when the fuel is passing through the fuel regulation apparatus 30. The electronic control unit 7 which has received the signal from the rotational position sensor 16 controls the electronic control fuel injection apparatus 10. The electronic control fuel injection apparatus 10 injects the fuel supplied from the fuel regulation apparatus 30 into the crankcase 8 at prescribed timing.

In general, an engine requires small fuel consumption at the time of low speed and requires at the time of high speed several times as large fuels as that at the time of low speed. In convention, a regulator placed in a supply system of fuel is an apparatus for maintaining constantly the pressure of fuel to be supplied and the fuel injection apparatus can control the rate of supply of the fuel for injection period by maintaining the pressure of fuel constantly. That is to say, the injection time is shortened at the time of low speed and lengthened at the time of high speed on the condition that the pressure is constant, Actually, however, the pressure varies depending on the quantity of fuel used and the pressure rises at the time of low speed and lowers at the time of high speed. And, therefore, the proper air-fuel ratio has not been conventionally maintained, since variations occur in the quantity of injection per time of the electronic fuel injection apparatus.

The fuel regulation apparatus 30 of this example resolves such problems as aforementioned and can accomplish the function to control the flow rate of fuel according to the rotational frequency of the engine. That is to say, when the engine is driven, the air pressure from the crankcase 8 is introduced into the piston chamber 40 through the air inlet 42 and pushes the piston 39 to separate the regulation valve 35 from the seat face 37. The fuel of the prescribed pressure flows toward the outlet 33 through the seat face 37. Since the air pressure in the crankcase 8 is proportional to the rotational frequency of the engine, the opening of the seat face 37 can be adjusted according to the rotational frequency and the control of the flow rate can be accomplished according to the rotational frequency.

It is predetermined by adjustment by means of the screw 43 of the air inlet 42 what extent of opening of the seat face 37 can be obtained by what extent of air pressure from the crankcase 8. That is to say, it is predetermined so as to supply sufficiently the fuel per one cycle which is apt to be insufficient at high speed rotation and so as to regulate properly the quantity of fuel which is apt to be thick at low speed rotation.

Figure 2:
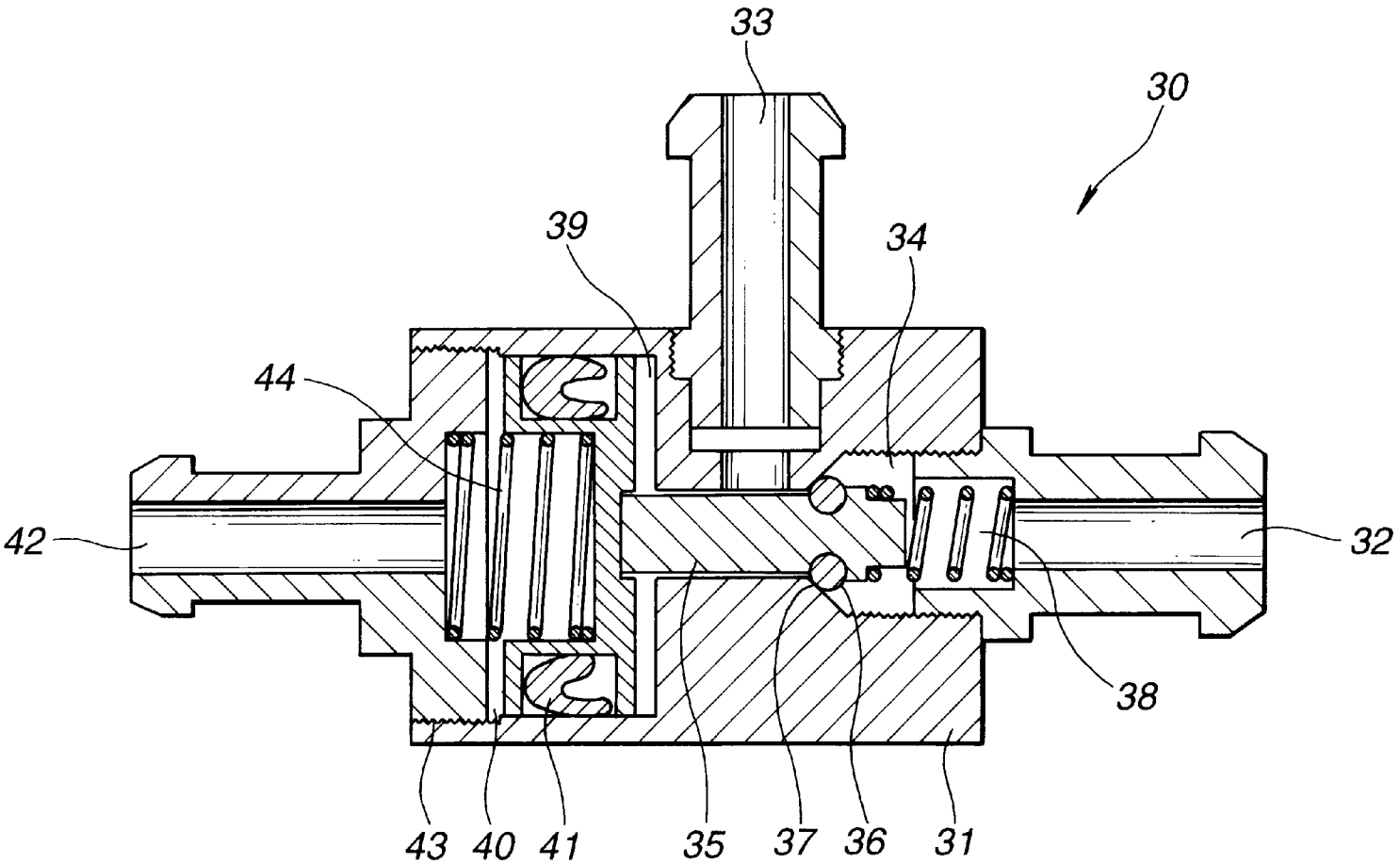
FIG. 2 is a cross section of a fuel regulation apparatus of a first example of working embodiments of this invention.

In FIG. 2, the air pressure generated in the crankcase 8 of the engine flows into the piston chamber 40 from the air inlet 42. For example, there is a difference in this air pressure, that is, it is 0 to 10 kPa at low speed and 40 to 50 kPa at high speed. Then, the force of the second spring 44 is adjusted optionally so as to open slightly the seat face 37 at the time of low speed, thereby the flow rate of fuel at low speed is throttled. The pressure of the fuel is controlled at approximately 30 kPa in proportion to the balance of the quantity used.

The pressure of the air pressure rises to 20 to 30 kPa at medium speed and becomes more intense in its force for pushing the piston 39 and moves the regulating valve 35 more greatly than at low speed. That is to say, the opening of the seat face 37 is larger than that at low speed. The fuel pressure is controlled at approximately 30 kpa in proportion of the quantity of fuel required at medium speed.

At the time of high speed, the air pressure becomes maximum and rises to 40 to 50 kPa. While the fuel consumption reaches its maximum because that the throttle is fully open and the quantity of air intake is large in the engine at high speed, the movement of the regulating valve 35 is large due to high air pressure and the opening of the seat face 37 reaches its maximum. Accordingly, the quantity of fuel supplied is balanced against the quantity of fuel used and the fuel pressure becomes 30 to 40 kpa.

As described above, according to the fuel regulation apparatus 30 of this example, since the opening of the seat face 37 in the passage 34 of the fuel regulation apparatus 30 can be controlled by the air pressure in the crankcase 8 according to the rotational frequency, the control of the flow rate can be carried out according to the rotational frequency of the engine. Thereby, the fuel per one cycle which is apt to be insufficient at high speed rotation can be supplied sufficiently and the quantity of fuel which is apt to be thick at low speed rotation can be throttled.

A radio control model airplane to which the engine 1 for a model equipped with the fuel regulation apparatus 30 of this invention is mounted can perform frequently an acrobatic flight such as loop and the like which is infrequently carried out by an actual air plane practically used. Under such severe condition for flight, the injection of fuel in a fuel injection apparatus is apt to be unstable. That is to say, the fuel in the fuel tank 21 or the fuel in a fuel supplying tube connecting the fuel tank 21 with the fuel injection apparatus 30 receives gravity and centrifugal force according to heavy flight operation of the model air plane, the magnitude and direction of which gravity and centrifugal force are changing continually. It is, therefore, difficult to maintain constantly the condition of injection of the fuel, and it is anticipated that there is a case in which fuel supply by injection becomes unstable in the engine mounted to the model air plane because of the influence of centrifugal force or gravity.

In the engine 1 for a model air plane of this example, however, since the fuel enclosed in the fuel tank 21 is supplied to the electronic control fuel injection apparatus 10 according to the rotational frequency by means of the fuel regulation apparatus 30 making use of the air pressure in the crankcase 8, the stability of operation at low speed and high speed is improved and a good response to requirement for rapid acceleration and slow down can be obtained, and further, an effect that the output power is improved can be obtained.

While it is explained hereinbefore that the fuel regulation apparatus 30 of each example as described above is placed to the engine 1 for a model mounted to the radio control model air plane, the expression "model" used herein is employed to mean not only a radio control model air plane for a hobby, but also a moving object to which a relatively small-sized engine usually used widely in industries is mounted including model cars, model ships and the like.

The second example of the working embodiments of this invention is explained with reference to FIGS.3 (*a*) and 3 (*b*).

This second example is relating to an integrated apparatus of the same fuel regulation apparatus 30 as aforementioned and the fuel injection apparatus for injecting the fuel supplied from the fuel regulation apparatus 30 into the crankcase 8, which is named generically as "fuel injection apparatus" as a whole. In the parts of the fuel regulation apparatus 30, the same reference characters as those used in the first example are also given to the parts corresponding to those of the first example in function and an explanation is partly omitted. Except for them, the structure of the engine for the model and the structures of each part of the receiver, transmitter and so forth, and the controlling apparatus as well as the sensors and so forth are the same as those in FIG. 1.

Figure 3B:
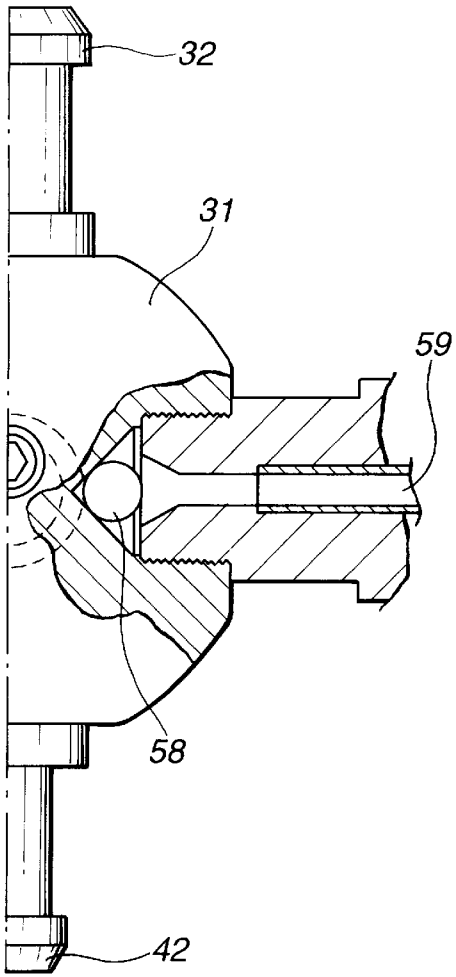
FIG. 3 is a cross section of a fuel regulation apparatus of a second example of working embodiments of this invention.
Figure 3A:
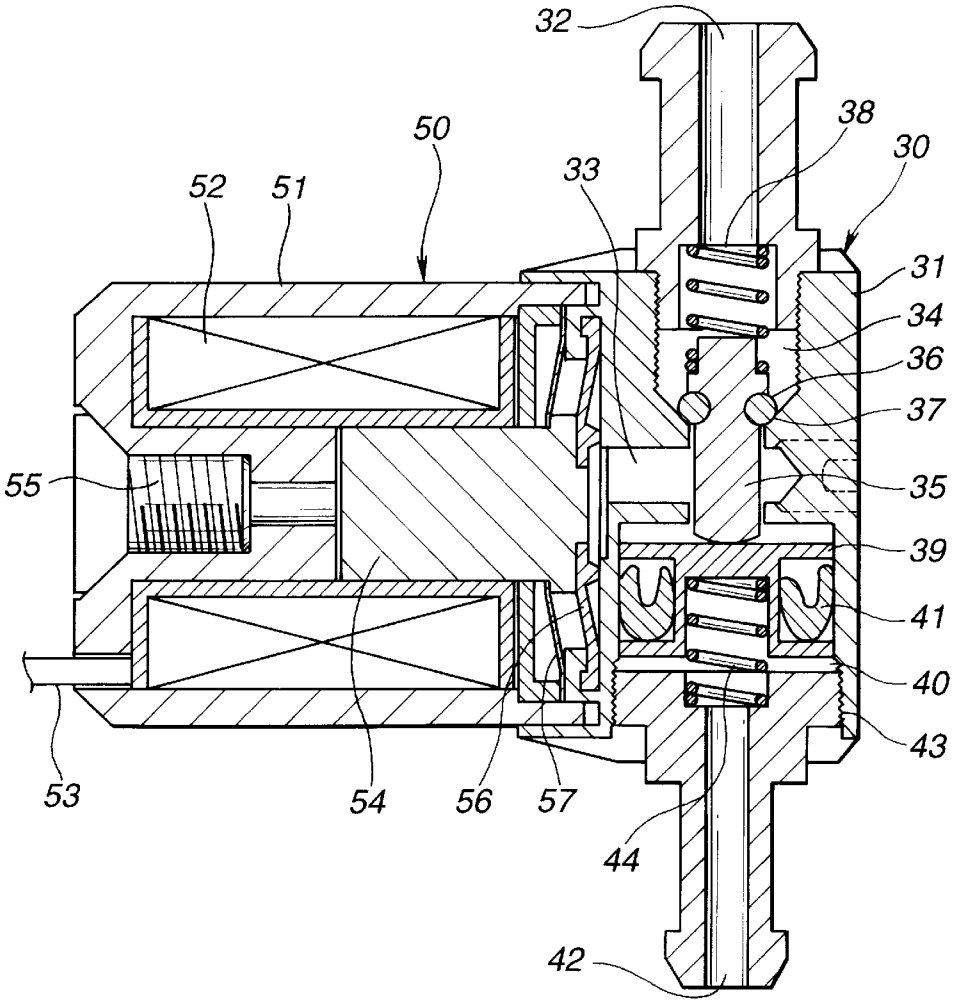

As shown in FIG. 3 (*a*), the fuel injection apparatus 50 is equipped with a box 51. The box 51 is connected at its one end to the fuel outlet 33 of the main body 31 of the fuel regulation apparatus 30. An electromagnetic coil 52 is placed in the box 51. A feeder 53 connected to the electromagnetic coil 52 is pulled out of the box 51. A valving element 54 is placed in the electromagnetic coil 52. A core 55 is placed to the other end of the box 51. A diaphragm valve 56 of nearly circle is fixed to a head of the valving element 54, by circular projection of which diaphragm valve 56 the periphery of the fuel outlet 33 of the fuel regulation apparatus 30 is closed. A leaf spring 57 of nearly circle (pushing means) is placed to a head of the valving element 54, which pushes the valving element 54 toward the outlet 33 so that the diaphragm valve 56 closes the outlet 33.

As shown in FIG. 3 (*b*), an inside of the box 51 is connected through an injection hole 58 to an injection pipe 59.

When a voltage is applied to the electromagnetic coil 52, the valving element 54 resists the pushing force of the leaf spring 57 to move to the left in FIG. 3 (*b*) the outlet 33 is connected to the inside of the box 51. The fuel the flow rate of which is determined according to the rotational frequency in the fuel regulation apparatus 30 is introduced through the outlet 33 into the box 51. And further, the fuel flows into an injection pipe 59 through the injection hole 58 to be injected into the crankcase 8.

Actions of the parts of the fuel regulation apparatus 30 are explained. The regulating valve 35 receives elastic force of the first spring 38 and fuel pressure per unit area. When the piston 39 is pushed by air pressure and elastic force of the second spring 44, the O-ring 36 of the regulating valve 35 is separated from the seat face 37 to form clearance. The pressurized fuel passes through the passage 34 to flow to the outlet 33. The quantity of the fuel supplied is controlled so as to become an injection quantity of the fuel injection apparatus 50, that is to say, quantity required for maintaining proper air-fuel ratio according to the rotational frequency of the engine.

Actions of the parts of the fuel injection apparatus 50 are explained. The informations from the rotational position sensor 16 are processed by the electronic control apparatus and voltage is applied to the electromagnetic coil 52 during the period according to the injection quantity required depending on the timing of inlet of the engine. By a magnetic field generated by the electromagnetic coil 52 to which a voltage has been applied, the valving element 54 adheres magnetically to the core 55. The diaphragm valve 56 which has been in a state of adhesion to the main body 31 is separated therefrom to form clearance and the fuel in the passage 34 flows into the box 51 and then injected into the crankcase 8 through the injection pipe 59 via the injection hole 58.

According to this example, since the fuel regulation apparatus 30 and the fuel injection apparatus 50 are integrated into one piece, the structure as a whole is compact and a pipe line system of fuel is simplified, and, therefore, this example is effective for the case where the space for mounting the apparatus can not be taken sufficiently like an engine for a model.

According to the fuel regulation apparatus for an engine for a model and the fuel injection apparatus using the same of this invention, since the flow rate of the fuel pressurized to prescribed pressure can be controlled by air pressure in the crankcase according to the rotational frequency of the engine, the proper fuel injection is possible also in a two-stroke cycle engine and the stable air-fuel ratio as well as stable rotational frequency can be obtained. Particularly, the stability at low speed rotation (idling) is improved. The rising from low speed rotation to high speed rotation is smooth. And, since the control of the fuel pressure is carried out closely near the engine, the fuel can be supplied stably without influences of difference in liquid level, gravity, and centrifugal force. Further, the fuel can be supplied stably also in acrobatic flight of an air plane or a helicopter.

What is claimed is:

1. A fuel injection system of an engine for a model, said fuel injection system having a fuel regulation apparatus and a fuel injection apparatus integrated into one unit, said fuel injection system comprising:

a fuel inlet for the fuel regulation apparatus;

a fuel outlet for the fuel regulation apparatus;

a fuel passage communicating said fuel inlet and said fuel outlet;

a regulating valve positioned in said fuel passage and configured to regulate opening of said fuel passage by using air pressure generated in a crankcase of the engine; and a diaphragm provided between said fuel outlet and said fuel injection apparatus, and configured to open and close said fuel outlet to the fuel injection apparatus.

2. The fuel injection system according to claim 1, further comprising a box provided inside the fuel injection apparatus and adjacent to said fuel outlet, wherein said box communicates with said fuel outlet when said diaphragm is opened.

3. The fuel injection system according to claim 1, further comprising a valving element provided in the fuel injection apparatus and configured to cause said diaphragm to open and close, wherein said diaphragm is fixed to said valving element.

4. The fuel injection system according to claim 3, further comprising an electromagnetic coil provided in the fuel injection apparatus and configured to cause said diaphragm to open and close by exerting electromagnetic force upon said valving element.

5. The fuel injection system according to claim 3, wherein:

said diaphragm has a circular shape and comprises a circular projection in a center portion thereof; and said valving element in the fuel injection apparatus is fixed to said diaphragm at said circular projection.

6. The fuel injection system according to claim 1, further comprising a spring positioned and configured to urge said diaphragm to close said fuel outlet.

7. The fuel injection system according to claim 1, further comprising:

a first elastic member positioned and configured to urge said regulating valve to close said fuel passage; and a piston positioned and configured to press said regulating valve against said first elastic member and open said fuel passage when the air pressure is supplied into the fuel regulating apparatus.

8. The fuel injection system according to claim 7, wherein said piston is coated with polytetrafluoroethylene.

9. The fuel injection system according to claim 1, wherein said regulating valve comprises an O-ring positioned and configured to tightly seal said fuel passage.

10. An engine for a model comprising the fuel injection system according to claim 1.

11. A model comprising the engine according to claim 10.

* * * * *